US005521442A

United States Patent [19]

Butterfield et al.

[11] Patent Number: 5,521,442

[45] Date of Patent: May 28, 1996

[54] AUTOMATIC POWER ANTENNA RETRACTION

[75] Inventors: Herbert R. Butterfield, Fenton; Michael D. Rizzo, Waterford; Clark E. McCall, Ann Arbor; Joseph A. Heller, Brighton; James V. Clore, Howell; Joseph R. Pastorek, Highland; Jonathan M. Rathbun, Brighton; David C. Poirier, Troy, all of Mich.

[73] Assignee: General Motors Corporation, Detroit, Mich.

[21] Appl. No.: 198,706

[22] Filed: Feb. 18, 1994

[51] Int. Cl.[6] ..... H01Q 1/10

[52] U.S. Cl. ..... 307/10.1; 343/903

[58] Field of Search ..... 307/9.1, 10.1, 307/141, 141.4, 120; 361/170; 343/901–903, 711, 713; 180/279, 281; 49/31; 340/436, 463, 602; 324/160, 161; 73/488; 318/280, 282, 283, 286, 483, 466, 468, 469

[56] References Cited

U.S. PATENT DOCUMENTS

| | | | |
|---|---|---|---|
| 2,473,050 | 6/1949 | Camp | 343/902 |
| 3,022,420 | 2/1962 | Brinkerhoff | 343/901 |
| 4,126,820 | 11/1978 | Hörmann et al. | 318/468 |
| 4,203,059 | 5/1980 | Kraus | 318/446 |
| 4,520,365 | 5/1985 | Langheck | 343/903 |
| 4,730,152 | 3/1988 | Foust et al. | 318/603 |
| 4,733,101 | 3/1988 | Graham et al. | 343/903 |
| 4,779,098 | 10/1988 | Blaese | 343/713 |
| 4,788,550 | 11/1988 | Chadima, Jr. | 343/712 |
| 4,825,226 | 4/1989 | Viola | 343/901 |
| 4,942,311 | 7/1990 | Harada | 343/901 |
| 4,990,836 | 2/1991 | Nakase et al. | 318/285 |
| 5,097,188 | 3/1992 | Nakase et al. | 318/466 |
| 5,212,725 | 5/1993 | Yamamoto et al. | 343/903 |

FOREIGN PATENT DOCUMENTS 1068379 12/1979 Canada .

*Primary Examiner*—William M. Shoop, Jr.
*Assistant Examiner*—Richard T. Elms
*Attorney, Agent, or Firm*—Anthony Luke Simon

[57] ABSTRACT

In a vehicle with a radio, a transmission, a brake, a throttle, a vehicle speed and a power antenna, a method of controlling the power antenna comprising the steps of: (a) determining whether the radio is in an on state; (b) determining if the transmission is one of: (i) in a neutral state and (ii) in an unengaged state; (c) determining if the brake is in an off state; (d) determining if the throttle is in an idle state; (e) determining if the vehicle speed is below a predetermined threshold; and (f) responsive to the determinations, if the radio is in the on state, the transmission is in one of: (i) the neutral state and (ii) the unengaged state, the brake is in the off state, the throttle is in the idle state and the speed is below the predetermined threshold, automatically retracting the power antenna, thereby preventing possible damage to the antenna by the automatic car wash.

7 Claims, 3 Drawing Sheets

AUTOMATIC POWER ANTENNA RETRACTION

This invention relates to control automotive vehicle power antennas and, more particularly, to a method and apparatus that provides automatic retraction of a vehicle power antenna to avoid damage to the power antenna when the vehicle is in an automated car wash.

BACKGROUND OF THE INVENTION

Many commercially available motor vehicles are equipped with power antennas. A power antenna is an antenna with a motorized mechanism that extends and retracts the antenna. Power antennas are generally less robust than fixed antennas and can experience damage when flexed beyond tolerable limits.

One source of damage to a power antenna may be an automatic car wash. Generally, car washes have brushes and/or other apparatus that pass over the car, including the car's antenna. When the car wash brushes encounter a power antenna, they may force the antenna to flex beyond tolerable limits, thereby damaging the antenna. The result may be a non-working antenna that needs to be replaced or repaired before it will again operate properly. This potential damage by automated car washes may be avoided by retracting the power antenna, which is typically achieved by turning off the vehicle ignition and/or radio. The damage typically occurs when the vehicle antenna is left extended when the vehicle rides through the automated car wash (i.e., the vehicle operator forgets to turn off the radio). One proposed solution for preventing damage to power antennas left extended in the vehicle car wash is set forth in U.S. patent application, Ser. No. 08/075,431, filed on Jun. 14, 1993, now abandoned in favor of continuing application Ser. No. 08/286,095, now abandoned.

SUMMARY OF THE PRESENT INVENTION

Advantageously, this invention provides a vehicle with a power antenna that avoids breaking or damage in an automated car wash. Advantageously, this invention provides a vehicle with a power antenna that avoids damage or breaking in an automatic car wash even if the operator fails to turn off the radio, which would typically cause the antenna to retract and avoid damage.

Advantageously, this invention provides an automatic control system for a vehicle power antenna that automatically lowers the antenna when the vehicle is in an automatic car wash to avoid damage to the antenna. Advantageously, this invention senses conditions of a vehicle's parameters to determine if the parameters are consistent with the vehicle being in an automated car wash and automatically lowers the vehicle antenna if the antenna is in an extended position and the parameters are consistent with the vehicle being in an automated car wash. Advantageously, this invention performs these functions responsive to parameters that are already measured or are otherwise available in a motor vehicle and without requiring additional sensors.

Advantageously, this invention achieves the advantages recited herein through a method of control of the vehicle power antenna comprising the steps of measuring a plurality of vehicle parameters; determining, responsive to the measurements, whether the measured parameters are consistent with the vehicle being in an automatic car wash; and controlling the power antenna responsive to the determination.

Performing the advantageous automatic power antenna control functions of this invention, the method of this invention may be implemented by the steps of: (a) determining whether a vehicle radio is on; (b) determining if the vehicle is in neutral; (c) determining if the vehicle brake is off; (d) determining if the vehicle throttle is at idle; (e) determining if the vehicle speed is below a predetermined threshold; and, (f) if the radio is on, the vehicle is neutral, the brake is off, the throttle is at idle and the speed is below the predetermined threshold, automatically retracting the power antenna.

The advantageous functions of this invention are performed by an apparatus having a structure comprising: means for measuring a plurality of vehicle parameters; means responsive to the measurements for determining whether the vehicle parameters are consistent with the vehicle being in an automatic car wash; and means for controlling the power antenna responsive to the means for determining.

Advantageously, one implementation of this invention achieves the advantages recited herein according to a structure comprising: means for determining if a vehicle radio is on; means for determining if a vehicle transmission is in neutral; means for determining if a vehicle brake is off; means for determining if a vehicle throttle is at idle; means for measuring the vehicle speed and determining if the vehicle speed is less than a predetermined threshold; and means for controlling the power antenna responsive to the determinations.

Advantageously, in yet another implementation, this invention provides an apparatus for achieving the functions and advantages recited herein according to a structure comprising: a first timer means for providing a first control output responsive to vehicle parameters indicating that the vehicle is in an automatic car wash; a controller comprising means for retracting the antenna responsive to the first control output, a second timer means for providing a second control output if the antenna is retracted responsive to the first control output, for a predetermined threshold time; and means for controlling the antenna to extend the antenna responsive to the second control output.

The advantageous structure and functions of this invention may be better understood with reference to the various embodiments of this invention set forth in the detailed description below.

DETAILED DESCRIPTION OF THE INVENTION

Figure 1:
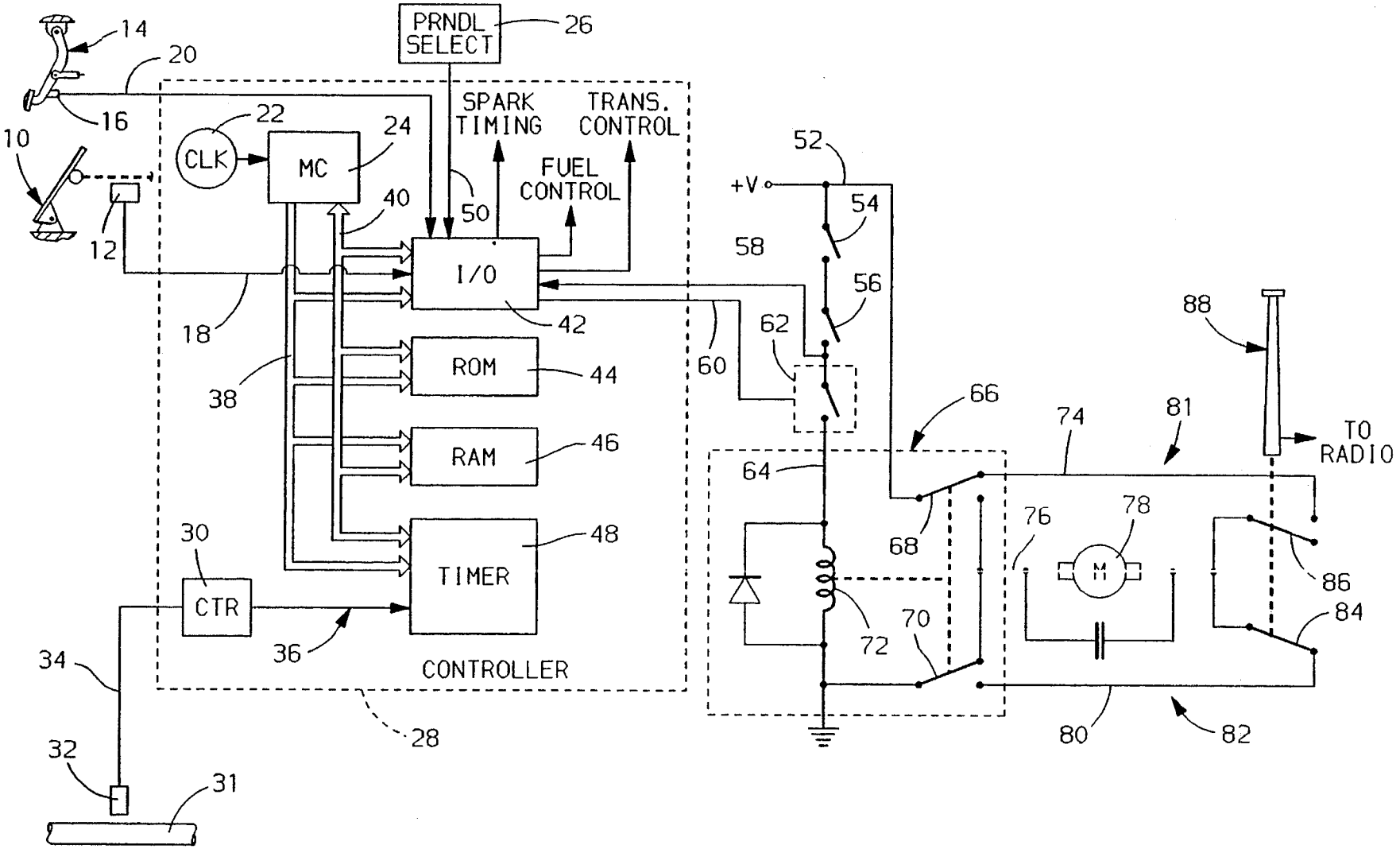
FIG. 1 is a schematic illustration of an apparatus according to this invention.

Referring to FIG. 1, the schematic shown illustrates an apparatus for implementation of this invention that utilizes information already available in a typical motor vehicle to affect to the automatic control of the power antenna. According to this invention, the apparatus monitors the state of various vehicle parameters and determines if those parameters provide signals consistent with the vehicle being in an automatic car wash. According to this invention, a criteria is set against which the various parameters are measured. The criteria represents a set of parameter measurement signals that, according to this invention, is consistent with the vehicle being in an automatic car wash. If the apparatus determines that the measured parameters meet the criteria, and are therefore consistent with a parameter set that would occur if the vehicle were in an automatic car wash, the apparatus automatically retracts the power antenna unit to thereby avoid damage to the power antenna unit by the automatic car wash.

The schematics shown include control module 28 and power antenna 82. Control module 28 may be a typical vehicle powertrain control module. The powertrain controller is utilized because the powertrain controller in a typical vehicle receives for other purposes, all, or most, of the information necessary to implement the invention according to the example shown. More particularly, controller 28 includes microprocessor 24, clock 22, ROM and RAM 44 and 46, input/output unit 42, timer 48, counter 30 and other conventional components and circuits of a vehicle powertrain control module, which other conventional components and circuits are omitted in the Figure because they are not central to the operation of this invention.

Microprocessor 24 performs control functions according to a computer control routine stored in the ROM 44 and, in performing its functions, transfers information between the various modules 24, 42, 44, 46, 48 via bi-directional data bus 40 with commands sent to the various modules through command bus 38. The control module 28 receives various information for use in controlling the vehicle engine and transmission, such as accelerator pedal information from accelerator pedal 10 provided through a position sensor 12 or through an airflow sensor responsive to air flow rate controlled by the engine throttle opening. The accelerator pedal (or throttle) information is provided on line 18 to the controller 28 via input/output unit 42.

Sensor 16 may be a conventional brake pedal switch of the type typically used to control rear brake lights. Sensor 16 provides a signal on line 20 to input/output unit 42 that indicates whether the brake pedal 14 is depressed.

Control module 28 receives a signal on line 50 indicative of the operator transmission gear selection. For a vehicle with an automatic transmission, PRNDL select 26 (i.e., a set of switches of a known type indicating which automatic transmission mode is selected) provides the operator selection. For a vehicle with a manual transmission, the signal on line 50 is provided responsive to the manual transmission selection and indicates whether the vehicle is in gear or is unengaged (not in gear). The signal on line 50 is provided to input/output unit 42 so that it can be processed by microprocessor 24.

Vehicle speed is provided by a sensor 32 sensing rotation of the transmission output shaft 31 and providing a signal on line 34 in the form of pulses, for example, one pulse with every rotation of transmission output shaft 34. The pulses are provided on line 34 to counter 30 within control module 28. Counter 30 counts the pulses and supplies the count through timer 48 via line 36. With the information from the counter 30 and timer 38, microcomputer 24 determines the transmission output shaft rotational rate 31, and thereby determines the vehicle speed, and stores the vehicle speed information in RAM 46.

In response to the various information provided, the typical functions of the control module 28 include control of the vehicle spark timing, engine fueling and automatic transmission (if provided). Such controls are readily known and easily implemented by those skilled in the art and are available on many commercially sold motor vehicles.

According to this invention, the parameters shown, including the throttle input responsive to accelerator pedal 10, the state of brake pedal 14, the state of the transmission select 26 and the vehicle speed 31 are used in a control routine implemented in microprocessor 24 to control the automatic retraction of power antenna 22. Additionally, a signal is provided to input/output unit 42 on line 58 indicative of whether the vehicle radio is switched on. More particularly, line 52 represents the vehicle power supply line. When the vehicle ignition is turned on, switch 54 closes and provides power to vehicle systems, such as the radio, which are only powered when the vehicle ignition switch is turned on. Reference 56 represents the vehicle radio on/off switch and, thus, line 58 provides a signal indicative of whether or not the vehicle ignition is on and the vehicle radio is switched on.

The power antenna includes 82 relay 66 and motorized module 81, which is controlled by the relay 66 to extend and retract antenna 88 using one of any known type of mechanism readily available to those skilled in the art. When switches 54, 56 and solid state switch 62 are closed, power is provided to coil 72 of single pull-double throw relay 66. In response, relay contacts 68 and 70 close to lines 76 and 80 respectively, providing power to motor 78. Line 80 is grounded at this time causing motor 78 to extend antenna 88. At the end of antenna travel, the internal up switch 84 opens, cutting off power to motor 78 and stopping antenna 88.

When either the ignition switch 54, regular switch 56 or solid state switch 62 is turned off, power to coil 72 of relay 66 is turned off. In response, relay contacts 68 and 70 provide positive voltage to line 74 and couple line 76 to ground. Power flows from line 74 through switch 86, motor 78, line 76 and switch 70 to ground causing motor 78 to operate in the reverse direction, retracting antenna 88.

At the end of antenna travel during retraction, antenna 88 causes the down switch 86 to open, turning off the motor 12. In the down position, the up switch is again closed. Those skilled in the an can easily implement motorized unit 81, relay 66, antenna up and down switches 86 and 84 and an extendable and retractable antenna 88 in any one of a number of known manners.

According to this invention, solid state switch 62 is normally closed to allow control of extension and retraction of the power antenna to be responsive to the vehicle ignition switch 54 and the radio on/off switch 56 in a conventional manner. In response to the radio on/off signal on line 58 and the parameter information provided by accelerator pedal 10, brake pedal 14, PRNDL select 26 and sensor 32, control module 28 determines, according to this invention, whether the vehicle is in an automatic car wash by determining if the measured parameters are consistent with the vehicle being in an automatic car wash. When control module 28 senses that the vehicle parameters are consistent with the vehicle being in an automatic car wash, control module 28 sends a signal on line 60 commanding switch 62 to open causing power antenna unit 82 to automatically retract antenna 88 to thereby avoid the possibility of damage to the power antenna 88 caused by brushes or other mechanisms in the automatic car wash.

In a preferred implementation, the control module 28 controls the power antenna responsive to a determination that the vehicle in an automatic car wash based on five factors. The first factor is whether the vehicle radio is on, as indicated by the on/off information in the signal on line 58. The second factor is whether the vehicle is in neutral (for an automatic transmission) or not in gear (for a manual transmission). The signal on line 50 or an equivalent signal for manual transmissions provides the transmission information. The third factor is whether the vehicle brake is not depressed. The signal on line 20, from brake pedal sensor 16, indicates whether the vehicle brake is depressed. The fourth factor is whether the engine throttle is at idle. This is determined by any number of means for sensing throttle position, which could be an accelerator pedal position sensor, an air flow meter signal indicating that the amount of air flow into the engine is consistent with vehicle at idle, or a throttle position sensor indicating a closed throttle. The fifth factor is whether the vehicle speed is less than a predetermined threshold speed, i.e., 2 m.p.h.

If the radio is on, the vehicle is in neutral (or not in gear), the brake is not depressed, the throttle is at idle and the vehicle speed is below the threshold speed for a predetermined time period, according to this invention, the control module 28 determines that the vehicle parameters are consistent with the vehicle being in an automatic car wash. Responsive to this determination, control modules 28 provides a signal on line 60 to open controllable switch 62, cutting power to coil 72 of relay 66 thereby causing the automatic retraction of antenna 88.

After the vehicle has passed through the car wash, the vehicle operator will take the vehicle out of neutral, which causes the above test to fail. In response thereto, control module 28 provides a signal on line 60 to close switch 62, returning power to coil 72 and thereby causing antenna 88 to extend and thereby returning control of power antenna unit 82 to the conventional control, which is responsive to ignition switch 54 and vehicle radio switch 56.

Thus advantageously, this invention provides, in a vehicle with a radio, a transmission, a brake, a throttle, a vehicle speed and a power antenna, a method of controlling the power antenna comprising the steps of: (a) determining whether the radio is in an on state; (b) determining if the transmission is one of: (i) in a neutral state and (ii) in an unengaged state; (c) determining if the brake is in an off state (i.e., if the brake pedal is not depressed); (d) determining if the throttle is in an idle state; (e) determining if the vehicle speed is below a predetermined threshold; and (f) responsive to the determinations, if the radio is in the on state, the transmission is in one of: (i) the neutral state and (ii) the unengaged state, the brake is in the off state, the throttle is in the idle state and the speed is below the predetermined threshold, automatically retracting the power antenna.

In implementation of this invention into control module 28, two timers are incorporated into the control routine to control the decision-making. The first is the decision timer that times the decision factors based on the parameter monitoring to determine if the signals representing the monitored parameters are consistent with those that occur in an automatic car wash for a first predetermined time period, such as two seconds. The second timer is the hold timer, which can be calibrated to an optimum second predetermined time period, such as about five minutes. The second timer is initialized when the antenna is automatically retracted in response to a sensed condition of the vehicle being consistent with the vehicle presence in an automatic car wash. After the antenna has been automatically retracted for five minutes, the second predetermined time period, and if the antenna was not automatically raised in response to a failing of one of the parameters consistent with the vehicle being in an automated car wash, the antenna is automatically raised on the assumption that the second predetermined time period is long enough for the vehicle to run through the automatic car wash. This eliminates the dependency of the automatic antenna extension on the transmission park/neutral switch or any of the other parameters.

Thus, advantageously, this invention provides, in a motor vehicle with an extendable and retractable power antenna, an apparatus comprising: a first timer means for providing a first control output responsive to a plurality of vehicle parameters when the plurality of vehicle parameters indicate that the vehicle is in an automatic car wash; means for retracting the power antenna responsive to the first control output; a second timer means for providing a second control output if the antenna is retracted responsive to the first control output for a predetermined threshold time; and means for extending the power antenna responsive to the second control output.

Figure 2A:
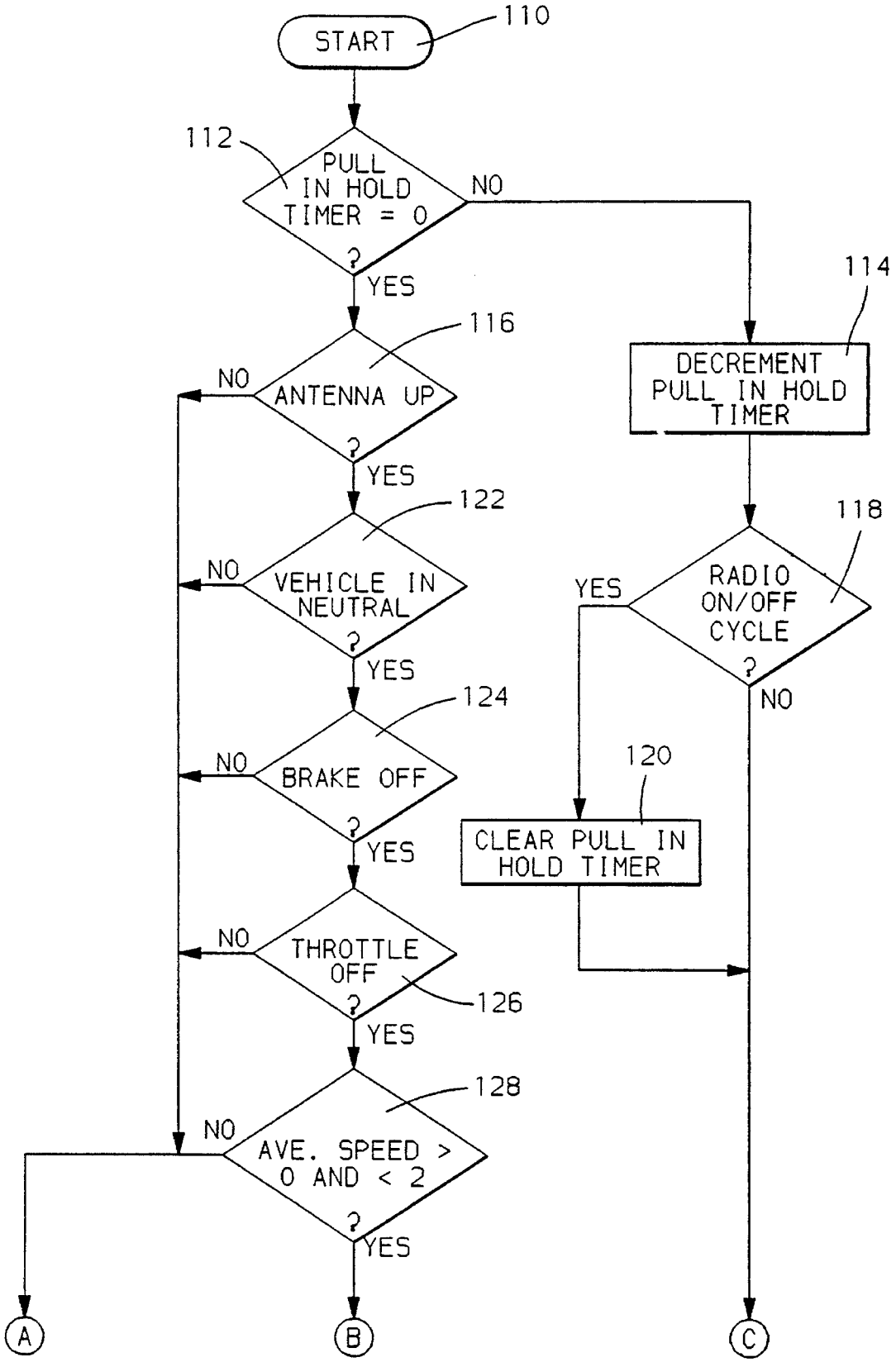
FIGS. 2*a* and 2*b* illustrate a flow diagram for implementation of this invention in a microprocessor-based system, such as shown in FIG. 1.
Figure 2B:
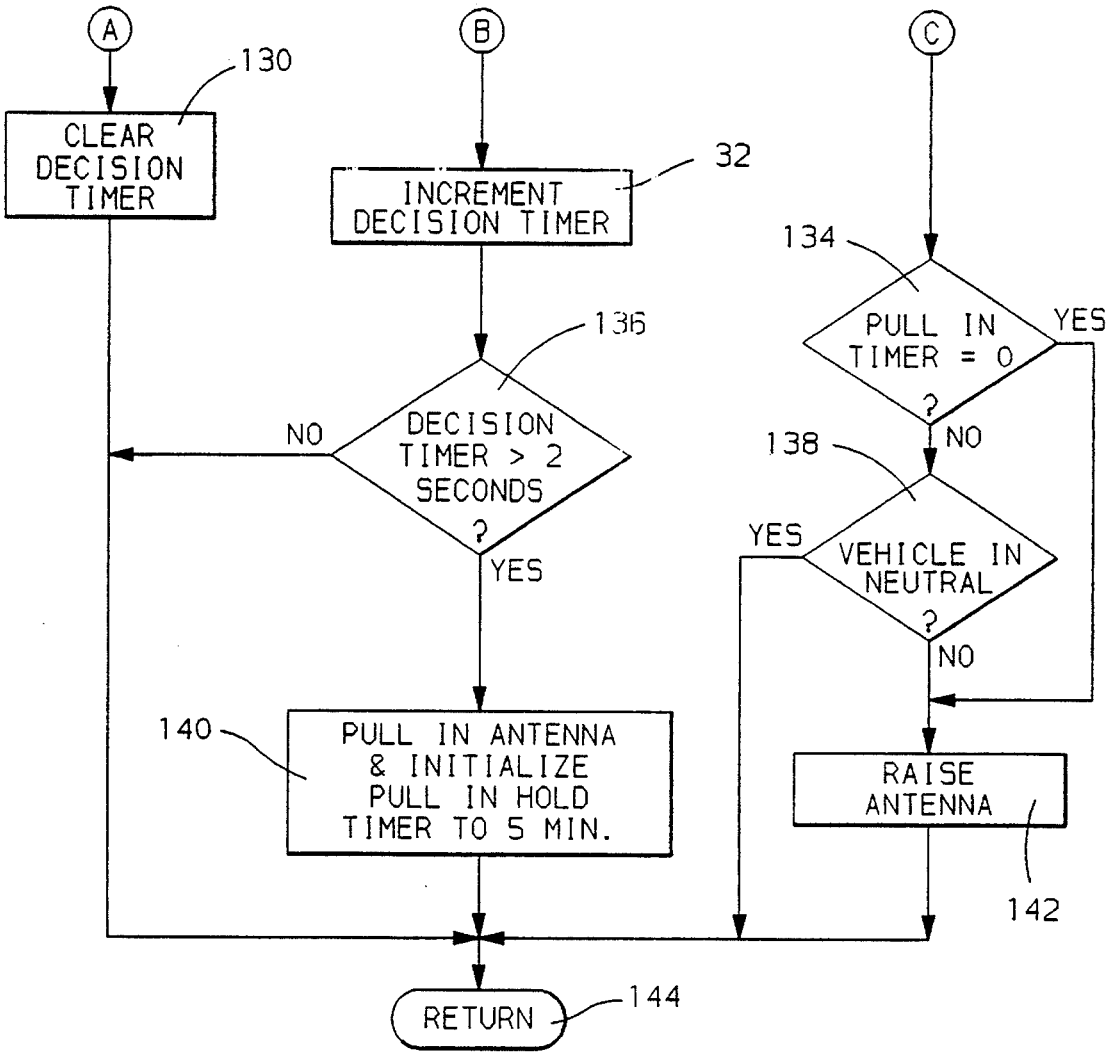

Referring now also to FIGS. 2*a* and 2*b*, the flow diagram shown illustrates the flow of the portion of the control routine run by microprocessor 24 for use in providing the automatic power antenna control according to this invention. The routine starts at block 110 and moves to block 112 where it determines if the hold timer is set to zero. In general, during initialization, values HOLD TIMER and DECISION TIMER, are initialized to zero. HOLD TIMER remains at zero unless an automatic retraction of the power antenna has occurred, in which case HOLD TIMER is set to a predetermined value HOLD TIME, the second predetermined time period. After the second predetermined time period passes, the antenna is again extended if it has not yet been extended and if the vehicle radio is not turned off.

If the HOLD TIMER is at zero, the routine moves to block 116 where it determines if the antenna is extended. This determination is in response to the signal on line 58 and the signal on line 60, which maintains switch 62 closed. If the vehicle radio and ignition are on, and the switch 62 has not been commanded open, it is assumed that the antenna is in the extended position. If the antenna is not extended, the routine moves to block 130, where the value DECISION TIMER is cleared and then moves to block 144 where it is exited.

If the antenna is extended at block 116, the routine moves to block 122 where it determines if the vehicle is in neutral in response to the signal on line 50. If the vehicle is not in neutral, the vehicle parameters, particularly the transmission signal, are not consistent with those that would occur when the vehicle is in an automatic car wash and the routine moves to block 130 and then exits at block 144. If the vehicle is in neutral, the routine continues to block 124 where it determines if the vehicle brake is off. If the vehicle brake is not off, the vehicle parameters, particularly the brake signal, are not consistent with those that would occur when the vehicle is rolling through an automatic car wash, so the routine moves to block 130 and then exits at block 144. If the vehicle brake is off, as determined by the signal on line 20, the routine moves to block 126 where it determines if the engine is at idle. Since, when moving through an automatic car wash, there is no need to depress the accelerator pedal, the accelerator pedal being depressed and/or the engine is not at idle indicates that the vehicle is not in an automatic car wash, so the routine continues to block 130 and 144 if the vehicle is not at idle.

If, at block 126, the vehicle is at idle, the routine continues to block 128 where it determines if the vehicle speed is between zero and a predetermined threshold speed, i.e., 2 m.p.h. A speed between zero and the predetermined threshold speed, when the vehicle is in neutral, the brake is off and the engine is at idle, indicates that the vehicle is rolling through an automatic car wash. If the vehicle speed at block 128 is not between zero and 2 m.p.h., the routine moves to block 130 and exits at block 144. If the vehicle speed is between zero and 2 m.p.h. the routine moves to block 132 where the value DECISION TIMER is incremented. The routine then moves to block 136 where DECISION TIMER is compared to a first predetermined time threshold, which may, for example, have a value of 2 seconds. If the value DECISION TIMER is not greater than the first threshold, the routine exits at block 144. If, at block 136, DECISION TIMER is greater than the first predetermined time threshold, the routine moves to block 140 where a signal is provided on line 160 commanding switch 62 to open, cutting current to coil 72 of relay 66, causing antenna 88 to automatically retract. Also at block 140, HOLD TIMER is initialized to the predetermined value HOLD TIME, for example, five minutes. The routine then exits at block 144.

If, at block 112, the value HOLD TIMER is not equal to zero, for example, if the routine has cycled to block 140, retracted the antenna and initialized HOLD TIMER to 5 minutes, the routine moves to block 114 where the value HOLD TIMER is decremented. At block 118, the routine determines if the radio has been cycled from on to off by monitoring the signal on line 58. If the radio has been turned off, there is no need to automatically extend the antenna when the vehicle exits the car wash, so the hold timer is cleared at block 120. The routine then moves to block 134, from either block 118 or 120, where it determines if HOLD TIMER is set to zero. If the hold timer is equal to zero, the routine moves to block 132 where it sends a signal on line 60, closing switch 62 and commanding antenna 88 to be extended, assuming that switch 56 has not been opened by the operator switching off the vehicle radio. If, at block 134, the HOLD TIMER is not equal to zero, the routine moves to block 138 where it checks to determine if the vehicle is in neutral. If the vehicle is not in neutral any longer, it is assumed that the vehicle is no longer in the automatic car wash and the routine moves to block 142 where the command is provided on line 160 to close switch 62, affecting an extending of antenna 88. If the vehicle is in neutral at block 138 and the HOLD TIMER has not decremented to zero, it is assumed that the vehicle is still in the automatic car wash and the routine is exited at block 144 without raising the antenna.

Thus, as can be seen by the illustrations of the above examples, this invention advantageously monitors vehicle parameters, determines if the parameters are consistent with those that would occur when the vehicle is an automatic car wash and automatically controls the antenna to retract the antenna in response to such an occurrence, thereby avoiding damage to the power antenna by the automatic car wash.

The above-described implementations of this invention are example implementations and are not limiting on the scope of this invention. While the invention is implemented in a microprocessor control routine in a vehicle powertrain controller, those skilled in the art will appreciate that implementation of this invention in another controller or in a discrete circuit implementation are considered as equivalents and falling within the scope of this invention. While switch 62 is described as a solid-state switch, it may easily be implemented as a relay to perform the same switching function. Additionally, the timer values and threshold provided above are preferred values. Those skilled in the art realize that the above values may be altered as a system designer desires while still practicing the method and apparatus of this invention. Moreover, various other improvements and modifications to this invention may occur to those skilled in the art and such improvements and modifications will fall within the scope of this invention as set forth below.

The embodiments of the invention in which an exclusive property or privilege is claimed are defined as follows:

1. A method of controlling a power antenna on an automotive vehicle comprising the steps of:

measuring a plurality of vehicle parameters to obtain a plurality of measurements thereof;

in an electronic controller responsive to the measurements, determining whether the measured parameters are consistent with the vehicle being in an automatic car wash; and outputting a command from the electronic controller, wherein the command controls the power antenna responsive to the determination.

2. The method of claim 1, wherein the command causes the power antenna to retract responsive to the determination when the measured parameters are consistent with the vehicle being in the automatic car wash.

3. In a vehicle with a radio, a transmission, a brake, a throttle and a power antenna, a method of controlling the power antenna comprising the steps of:

(a) determining whether the radio is in an on state;

(b) determining if the transmission is in a transmission state comprising one member of a set of transmission states comprising: (i) a neutral state and (ii) an unengaged state;

(c) determining if the brake is in an off state;

(d) determining if the throttle is in an idle state;

(e) determining if a speed of the vehicle is below a predetermined threshold, wherein steps (a)–(e) are performed in an electronic controller; and (f) outputting a command from the electronic controller to automatically retract the power antenna to avoid antenna damage by an automatic car wash responsive to the determinations, wherein the power antenna is automatically retracted if the radio is in the on state, the transmission is in one of: (i) the neutral state and (ii) the unengaged state, the brake is in the off state, the throttle is in the idle state and the speed is below the predetermined threshold.

4. In a motor vehicle with an extendable and retractable power antenna, an apparatus comprising:

a controller in the vehicle receiving a plurality of measurements of various vehicle parameters;

a microprocessor within the controller for performing a series of control routine steps responsive to the measurements for determining whether the vehicle parameters are consistent with the vehicle being in an automatic car wash and for outputting a control command responsive to the determination; and a switch in a circuit of the power antenna coupled to the controller and responsive to the control command, wherein the switch controls extension and retraction of the power antenna responsive to the control command.

5. The apparatus of claim 4, wherein the microprocessor outputs the control command to retract the power antenna when the vehicle parameters are consistent with the vehicle being in the automatic car wash.

6. In a motor vehicle including a radio, a transmission, a brake, a throttle and an extendable and retractable power antenna, an apparatus comprising:

an electronic controller receiving signals indicative of whether the radio is in an on state, the transmission is one of: (i) in a neutral state and (ii) in an unengaged state, the brake is in an off state, the throttle is in an idle state, and a speed of the vehicle is less than a predetermined threshold; and a microprocessor within the electronic controller for controlling the power antenna responsive to the received signals to retract the antenna if the radio is in the on state, the transmission is in one of: (i) the neutral state and (ii) the unengaged state, the brake is in the off state, the throttle is in the idle state and the speed is below the predetermined threshold.

7. In a motor vehicle with an extendable and retractable power antenna, an apparatus comprising: a first timer means for providing a first control output responsive to a plurality of vehicle parameters when the plurality of vehicle parameters indicate that the vehicle is in an automatic car wash; means for retracting the power antenna responsive to the first control output; a second timer means for providing a second control output if the antenna is retracted responsive to the first control output for a predetermined threshold time; and means for extending the power antenna responsive to the second control output.

* * * * *